United States Patent [19]

Spencer et al.

[11] Patent Number: 4,744,944

[45] Date of Patent: May 17, 1988

[54] PROCESS FOR PRODUCING TUNGSTEN HEAVY ALLOY BILLETS

[75] Inventors: James R. Spencer, Sayre; De Wayne R. Grover, Towanda, both of Pa.

[73] Assignee: GTE Products Corporation, Stamford, Conn.

[21] Appl. No.: 81,779

[22] Filed: Aug. 5, 1987

[51] Int. Cl.[4] ..... C21D 1/00

[52] U.S. Cl. ..... 419/23; 75/248; 419/29; 419/46; 419/47; 419/53; 419/54; 419/58

[58] Field of Search ..... 419/23, 58, 53, 54, 419/46, 47, 29; 75/648

[56] References Cited

U.S. PATENT DOCUMENTS

| | | | |
|---|---|---|---|
| 3,888,636 | 6/1975 | Sctertenie et al. | 75/248 |
| 3,979,209 | 9/1976 | Snyder | 75/248 |
| 3,979,234 | 9/1976 | Northcutt et al. | 419/54 |
| 4,012,230 | 3/1977 | Dickinson et al. | 419/54 |
| 4,090,875 | 5/1978 | Ludwig | 75/248 |
| 4,670,216 | 6/1987 | Patrician | 75/248 |
| 4,698,096 | 10/1987 | Schmidberger | 75/248 |

*Primary Examiner*—Stephen J. Lechert, Jr.
*Attorney, Agent, or Firm*—Donald R. Castle; L. Rita Quatrini

[57] ABSTRACT

A process is disclosed for producing tungsten heavy alloy billets. The process involves forming a uniform blend of elemental powders to form a tungsten alloy having a tungsten content of equal to or less than about 91% by weight and wherein the particle size of the tungsten is no less than about 2 micrometers in diameter. This blend is uniformly packed into a container having thermal expansion similar to that of the powder. The blend is then sintered in a hydrogen atmosphere at a temperature sufficient to impart strength to the powder and to reduce oxides and remove volatile impurities from the powder without significant densification in the powder. The powder is then solid state sintered in a reducing atmosphere at a sufficient temperature to densify the powder to at least about 90% of the theoretical density but at a temperature below the liquid phase sintering temperature of the powder, to form the billet. If the tungsten content of the alloy is greater than about 88% by weight, the solid state sintered powder can then be liquid state sintered by slowly raising the temperature from the solid state sintering temperature to the liquid phase sintering temperature and holding at this temperature for a sufficient time to accomplish the liquid sintering and achieve a density of greater than about 99% of the theoretical density in the billet.

8 Claims, No Drawings

PROCESS FOR PRODUCING TUNGSTEN HEAVY ALLOY BILLETS

This invention relates to a process for producing fully dense tungsten heavy alloy billets by sintering loose filled beds or the powder blend.

BACKGROUND OF THE INVENTION

Tungsten heavy alloy sheet can be produced by rolling sintered billets of the alloy. Because the rolling requires numerous anneals, it is desirable that the starting billet be no more than about twice the final thickness. One method to produce these billets is by isostatically pressing the powder alloy blends and sintering them to full density. With thin billets, it is difficult to to get a uniform fill of the mold so the resulting billets are not uniform in thickness. There is also a problem with breakage with the thin billets. By this method it is not possible to produce billets with a surface area to thickness ratio much over 600 or thicknesses less than about 0.5". A similar method is to press large billets and cut the green billet into thin slabs. While this produces billets of uniform thickness, it has the size limitations of the previous method and there is the added expense of cutting.

Several other methods of preparing rollling slabs involve preparing a thick slurry of the powder blend with binders and other agents and then preparing the sheet from the slurry by extruding, tape casting, or pouring and leveling on a table. Once the solvent is removed, the sheet can be handled and cut. These methods can produce thin sheets but thicker sheets are difficult or impossible to form. A big disadvantage of these processes is that binder addition and binder removal steps must be inserted into the process. Also it is difficult to obtain optimum mechanical properties in tungsten heavy alloys that have been prepared with organic binders used somewhere in the process. This is due to presence of carbon in the organics.

SUMMARY OF THE INVENTION

In accordance with one aspect of this invention, there is provided a process is for producing tungsten heavy alloy billets. The process involves forming a uniform blend of elemental powders to form a tungsten alloy having a tungsten content of equal to or less than about 91% by weight and wherein the particle size of the tungsten is no less than about 2 micrometers in diameter. This blend is uniformly packed into a container having thermal expansion similar to that of the powder. The blend is then sintered in a hydrogen atmosphere at a temperature sufficient to impart strength to the powder and to reduce oxides and remove volatile impurities from the powder without significant densification in the powder. The powder is then solid state sintered in a reducing atmosphere at a sufficient temperature to densify the powder to at least about 90% of the theoretical density but at a temperature below the liquid phase sintering temperature of the powder, to form the billet.

In accordance with another aspect of this invention, if the tungsten content of the alloy is greater than about 88% by weight, the solid state sintered powder can be liquid state sintered by slowly raising the temperature from the solid state sintering temperature to the liquid phase sintering temperature and holding at this temperature for a sufficient time to accomplish the liquid sintering and achieve a density of greater than about 99% of the teoretical density in the billet.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

By the process of the present invention, large thin billets of tungsten heavy alloys can be produced which are fully dense and which are not cracked. Thickness of the billet is not a limitation and no binders are used in the process. The process required little in the way of equipment.

The process involves the general steps of sintering uniformly packed powder in a special container, followed by solid state sintering. Depending on the nautre and properties desired in the application in which the product is to be used, the powder can be either solid state sintered to produce the billet, or soild state sintered followed by liquid state sintering to produce the billet.

A uniform blend is formed of the elemental powders from which the alloy is formed. Some preferred blends, although the invention is not limited to such, consist essentially of from about 90% to about 95% by weight tungsten with Ni/Fe weight rations of from about 7/3 to about 9/1 to produce the corresponding alloys. The particle size of the tungsten component must be greater than about 20 micrometers in diameter and usually from about 3 micrometers to about 8 micrometers in diameter. For this invention, sizes of from about 4 to about 6 micrometers in diameter are especially preferred.

The powders are blended by standard blending techniques for dry powders.

The powder blend is uniformly packed into a container which is made of a material which has similar thermal expansion to the powder. The preferred containers are coated molybdenum in the form of trays. Especially preferred containers are of zirconia coated molybdenum and alumina coated molybdenum. Usually, the powder is introduced into the trays and shook or vibrated and tamped to develop uniform packing of the powder. The trays are overfilled so that a straight edge can be drawn across the top of the tray to give a flat surface.

The tray of powder is then sintered in a hydrogen atmosphere at a temperature sufficient to impart strength to the powder and reduce the oxides and remove impurities from the powder without significant densification in the powder. The sintering conditions depend on the nature of the particular blend. For example, the finer tungsten particle sizes require lower temperature to avoid densification. Typically, the temperature is slowly raised to about 900° C. to about 1000° C., and then held at this temperature usually for from about 1 to about 2 hours. Because of the particle size of the tungsten and the sintering temperatures there is no desification shrinkage but there is considerable development of bed strength. Because no shrinkage occurs and the thermal expansion of the tray material is similar to the bed's thermal expansion, cracks do not develop. At this point the bed is strong enough to handle and strong enough to prevent crack formation during the densification shrinkage that occurs in the next sintering step.

The resulting strengthened powder bed is then solid state sintered in a reducing atmosphere, preferably hydrogen, at a sufficient temperature to densify the powder to at least about 90% of the theorectical density but below the liquid phase sintering temperature, to form the billet. The temperature must remain below the liquid sintering temperature of the material. Densification takes place most typically to about 90% to about 96% of the theoretical density. The solid state sintering conditions depend on the tungsten particle size of the material. For example, higher temperatures are required for larger tungsten particle sizes. However, the sintering temperatures are generally from about 1400° C. to about 1430° C. The preferred sintering times at these temperatures are from about 2 hours to about 4 hours. At this point, the sintered bed can be removed from the container. The alloys having less than about 88% by weight tungsten are not liquid phase sintered and can be rolled at this point.

After the solid state sintering, the powder can be heat treated in a non-reactive atmosphere at a sufficient temperature for a sufficient time to remove essentially all of the hydrogen from the billet. The atmosphere can be, for example, nitrogen or vacuum. Typically, the temperature range from about 1000° C. to about 1200° C. The heat treating insures that the billets have good ductilities.

If the alloys contain greater than about 88% by weight tungsten, the material can be first processed as described above through the solid state sintering step. The solid state sintered bed of powder can then be liquid phase sintered to achieve a density of greater than about 99% of the theoretical density. This is done typically by slowly raising the temperature from the solid state sintering temperature range to the liquid phase sintering temperature for a sufficient time to accomplish the liquid phase sintering. The temperature should be raised at a slow enough rate to insure that the billet reaches the liquid phase temperature state uniformly. Temperatures and times depend on the alloy. Higher tungsten contents require higher temperatures and longer times. Usually the temperature is about 10° C. about the temperature at which the liquidus forms. However, the preferred liquid sintering temperatures are from about 1460° C. to about 1560° C. The preferred times at these temperatures are from about 0.5 hours to about 1 hours. Because the billets have been solid state sintered to near full density, there is little chance of trapping porosity during the liquid phase sintering.

After the liquid phase sintering, the alloys are heat treated as described previously to remove hydrogen.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing tungsten heavy alloy billets, said process comprising:

(a) forming a uniform blend of elemental powders to form tungsten alloys having a tungsten content of equal to or less than about 91% by weight and wherein the particle size of said tungsten is no less than about 2 micrometers in diameter;

(b) uniformly packing said powder blend into a container, said container being made of material having thermal expansion similar to said powder blend;

(c) sintering said powder blend in a hydrogen atmosphere at a temperature sufficient to impart strength to said powder and to reduce oxides and remove volatile impurities from the powder without significant densification in the powder; and (d) solid state sintering the resulting strengthened powder in a reducing atmopshere at a sufficient temperature to densify said powder to at least about 90% of the theorectical density but at a temperature below the liquid phase sintering temperature of said powder blend to form the billet.

2. A process of claim 1 comprising the additional step of heat treating said solid stated sintered powder in a non-reactive atmosphere at a sufficient temperature for a sufficient time to remove essentially all of the hydrogen from said billet.

3. A process of claim 1 wherein said container is made of coated molybdenum.

4. A process of claim 3 wherein said container is made of material selected from the group consisting of zirconia coated moylbdenum and alumina coated molybdenum.

5. A process for producing tungsten heavy alloy billets, said process comprising:

(a) forming a uniform blend of elemental powders to form tungsten alloys having a tungsten content of greater than 88% by weight and wherein the particle size of said tungsten is no less than about 2 micrometers in diameter;

(b) uniformly packing said powder blend into a container, said container being made of material having thermal expansion similar to said powder blend;

(c) sintering said powder blend in a hydrogen atmosphere at a temperature sufficient to impart strength to said powder and to reduce oxides and remove volatile impurities from the powder without significant densification in the powder;

(d) solid state sintering the resulting strengthened powder in a reducing atmosphere at a sufficient temperature to densify said powder to at least about 90% of the theoretical density but at a temperature below the liquid phase sintering temperature of said powder blend; and (e) liquid phase sintering said solid state sintered powder by slowly raising the temperature from said solid state sintering temperature to the liquid phase sintering temperature and holding at said liquid phase sintering temperature for a sufficient time to accomplish the liquid sintering and achieve a density of greater than about 99% of the theorectical density in the billet.

6. A process of claim 5 comprising the additional step of heat treating said solid state sintered powder in a non-reactive atmosphere at a sufficient temperature for a sufficient time to remove essentially all of the hydrogen from said billet.

7. A process of claim 5 wherein said container is made of coated molybdenum.

8. A process of claim 7 wherein said container is made of material selected from the group consisting of zirconia coated molybdenum and alumina coated molybdenum.

* * * * *